US005988683A

United States Patent [19]

Venier et al.

[11] Patent Number: 5,988,683

[45] Date of Patent: Nov. 23, 1999

[54] REPLACEABLE BLADE SKATE

[75] Inventors: Fabio Venier, Holland Landing; Markus Hetzler, Brampton, both of Canada

[73] Assignee: Quickblade Inc., Markham, Canada

[21] Appl. No.: 08/797,272

[22] Filed: Feb. 7, 1997

[51] Int. Cl.[6] ..... A63C 1/00

[52] U.S. Cl. ..... 280/841; 280/11.12; 7/138

[58] Field of Search ..... 280/891, 11.12, 280/11.17, 11.18, 28, 811, 825; 7/138; 81/436

[56] References Cited

U.S. PATENT DOCUMENTS 3,015,492 1/1962 Kesner et al. ..... 280/825

4,015,762 4/1977 Mendillo ..... 280/814

5,088,749 2/1992 Olivieri ..... 280/11.8

5,248,156 9/1993 Cann et al. ..... 280/11.12

*Primary Examiner*—Robert J. Oberleitner

*Assistant Examiner*—Robert J. McCarry, Jr.

*Attorney, Agent, or Firm*—Frost & Jacobs LLP

[57] ABSTRACT

A replaceable blade skate comprises inexpensive, light, easily changed blades adapted to fit to multiple rocker curvatures. A torque limiting device provides for easy replacement and adjustment of blades by consumers. Replaceable toe and heel caps provide protection and color-coding. The sometimes undesirable gap between the boot and blade portion of the skate can be eliminated with the construction of the skate of the invention.

28 Claims, 15 Drawing Sheets

REPLACEABLE BLADE SKATE

BACKGROUND

Ice skates have been used for recreational and transportation purposes for hundreds of years. Originally, some sort of low friction sliding device akin to a metal blade was attached using straps to a conventional boot. Eventually, in this century, boots specifically intended for use only in ice skating evolved, typically with the blade firmly affixed to the boot. The unitary blade and boot had the advantage of rigidity allowing more speed and control than previously possible.

For many years, it has been realized that there may be an advantage to providing a replaceable sharpened blade for ice skates. With heavy use, typically a conventional skate blade will wear out before the boot portion. Accordingly, there is an advantage to extending the life of the skate by replacing the blade rather than replacing the entire skate.

For advanced skaters particularly, the degree of curvature of the blade (referred to as "rocker" in the industry) is important. Different skaters will choose different rocker curvatures depending upon their personal preferences. Unfortunately, with conventional skate construction, manual sharpening of the skates in which the blade and rocker are synonymous, tends to vary the rocker curvature slightly. Over the course of the lifetime of a conventional skate, this curvature can vary dramatically.

In addition, sharpening must normally be done by someone other than the skater using special grinding equipment. This is often inconvenient to the skater and involves a certain expense.

The fact that skates must be gripped in some kind of vice to allow sharpening dictates that there be open space between the blade and the boot sufficient for the vice grips to pass through. This open space may be hazardous since it may allow a puck to be temporarily trapped in the skate, and it may provide an opening sufficient to catch a hockey stick blade causing the skater to lose balance or fall.

In addition, certain of the prior art attempts to provide replaceable skate blades have involved replacement of a relatively heavy and thus expensive, metal portion of the skate with substantial removal and fastening difficulties. Some such replaceable blades were intended to be sharpened a number of times before replacement. See, for example U.S. Pat. No. 5,088,749 to Olivieri. In other prior art attempts, the replaceable blade, although lightweight, has not been effectively mounted on the rocker to provide the security required particularly by advanced skaters. See, for example, U.S. Pat. No. 2,108,128 to Kinney. Still other replacement blades have been of a complex construction not easily adapted to inexpensive commercial production. See, for example, German Patent No. 724488 to Dornseif and U.S. Pat. No. 3,947,050 to Isely. Moreover, replaceable blades have tended to be prone to breakage owing to the structure of the blade and the tension under which the blade is placed in order to stretch it along the base of a skate blade. See, for example, U.S. Pat. No. 5,383,674 to Cann, et al.

The present invention solves these prior art problems. The skate of the present invention comprises an inexpensive, light, easily changed blade which can be replaced with little or no wear on the remainder of the skate. A result of the construction of the new skate is that the rocker curvature will not vary as a result of manual sharpening. In addition, different rocker curvatures can be chosen according to the user's preference and the identical replaceable blade can be used with all such rocker curvatures. The rockers themselves may be replaced according to the preference of the skater. The problem of excess breakage of replaceable blades has been solved using novel means to connect the blade to the skate. A torque limiting device provides for easy replacement and adjustment of blades by consumers without damage to the skate or the replaceable blade.

A benefit of the construction of the invention is that replaceable toe and heel caps can be used which provide protection from otherwise sharp or protruding surfaces. In addition, these caps may be coded by colour to allow identification of the ice skates on an individual or team basis.

Moreover, since there is no need for a gap between the blade portion and the boot of the skate using the invention, the construction is safer than conventional skates.

SUMMARY OF THE INVENTION

Accordingly, the ice skate of the present invention comprises a boot; a rigid holder adapted to be mounted to the boot; the holder having a downwardly facing rocker portion of a first defined curvature, a front end and a rear end; a flexible replaceable blade having a second defined curvature; the blade having a front end and a rear end and being adapted to be removed from or mounted to the downwardly facing rocker portion of the holder; front attachment means for securing the front end of the blade to the front end of the rocker portion of the holder; rear attachment means for securing the rear end of the blade to the rear end of the rocker portion of the holder; wherein the front and rear attachment means cooperate to create tension along the length of the blade.

In an aspect of the invention, the blade is formed with a groove along its length which is adapted to seat against, or mate with, a corresponding ridge or tongue along the downwardly facing portion of the holder.

In another aspect of the invention, at least one of the attachment means comprises a torque limiting mechanism. The rear attachment means may comprise such a torque limiting mechanism.

In another aspect of the invention, the blade of a fixed second curvature is capable of being mounted on the rocker portion of a holder, the downwardly facing surface of which may have any of a variety of first curvatures.

In a further aspect of the invention, the blade is curved more than 90° at both the front end and the rear end thereof for placement and attachment into the front and rear attachment means.

In another aspect of the invention, the front and rear portions of the holder and the blade are covered with plastic or rubber end caps, which may be of any desired colour.

In a further aspect of the invention, the holder is mounted to the boot leaving substantially no gap therebetween.

DETAILED DESCRIPTION OF THE INVENTION

Figure 1:
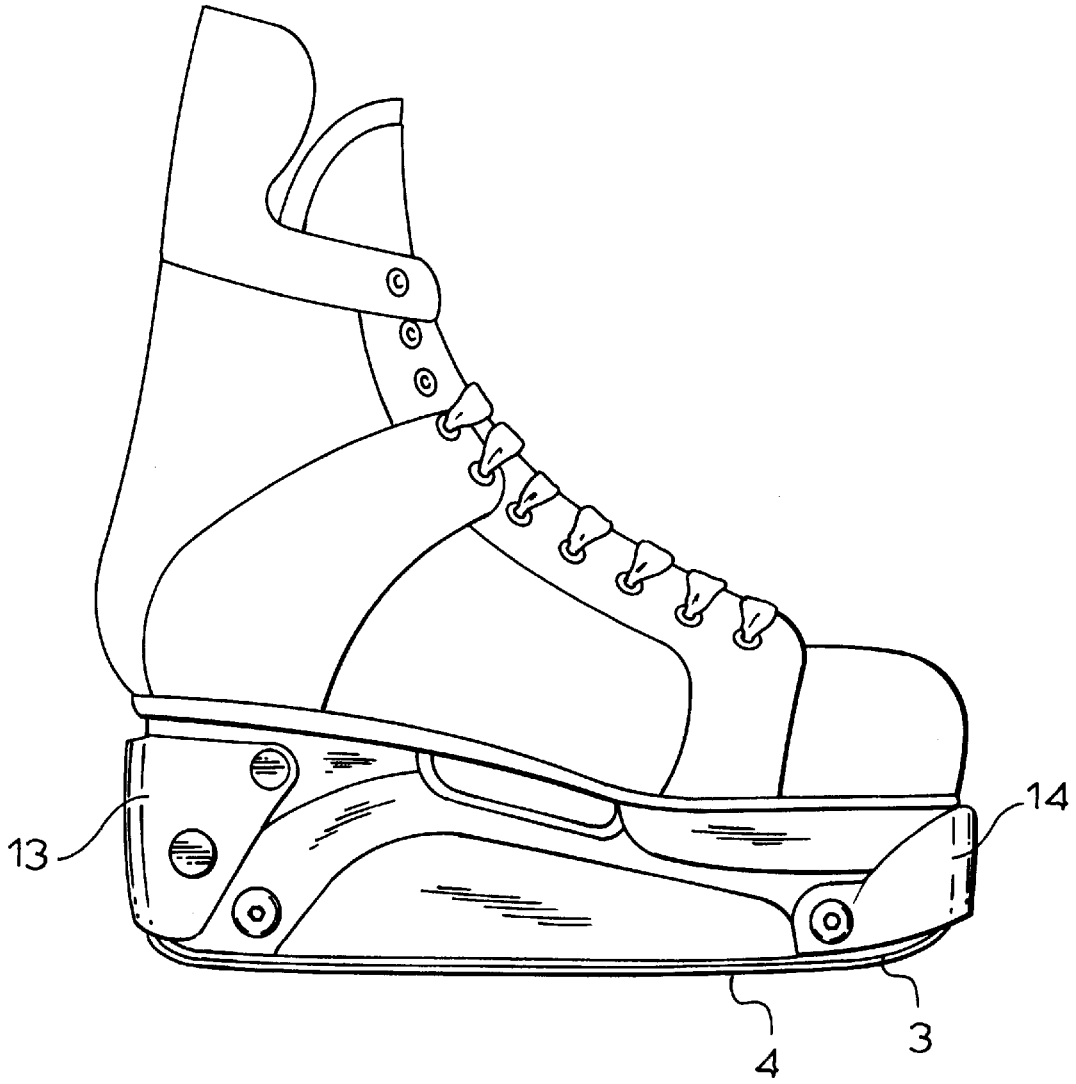
FIG. 1 is a side view of the assembled skate.
Figure 2:
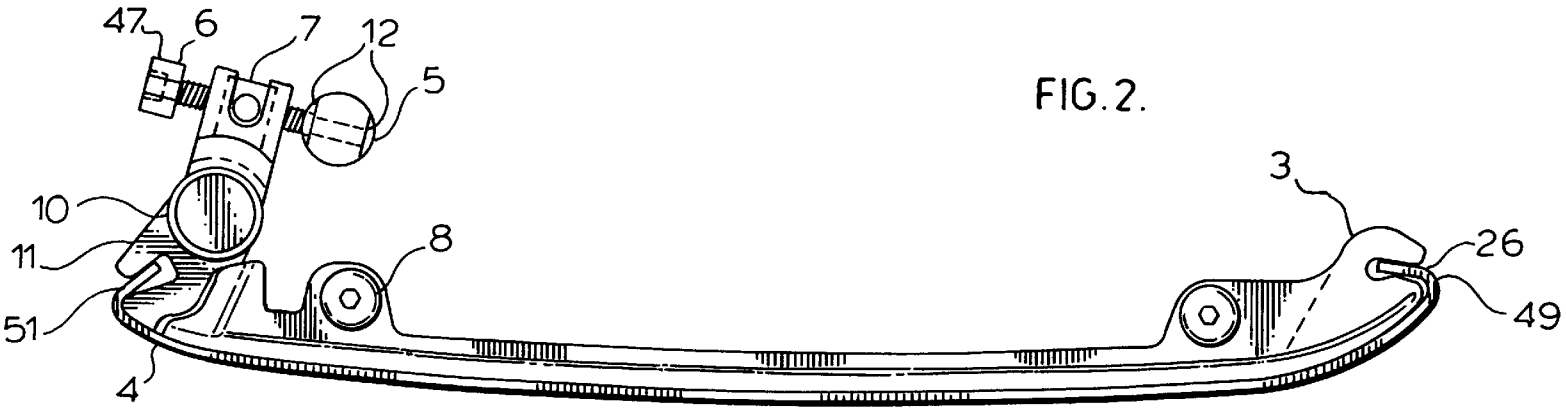
FIG. 2 is a schematic view of a section through the rocker, blade and attachment means.
Figure 4:
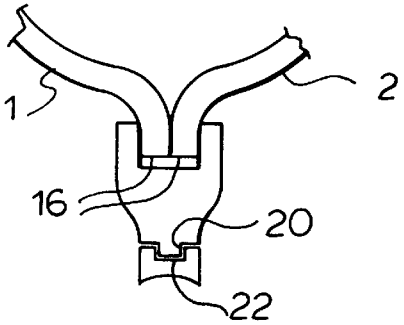
FIG. 4 is a schematic view of a section through the holder, rocker and blade.
Figure 3:
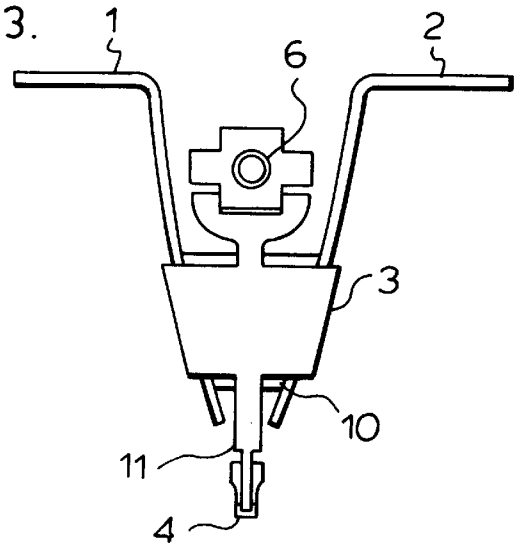
FIG. 3 is a schematic view of a section through the holder, rocker and blade.
Figure 5A:
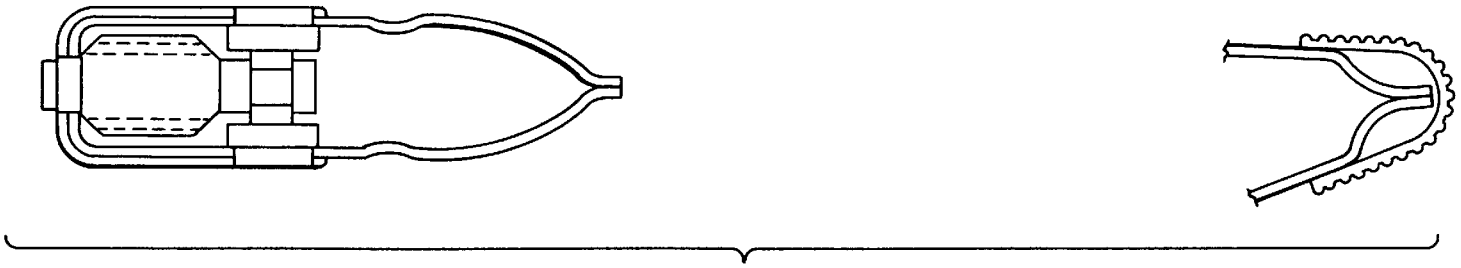
Figure 5B:
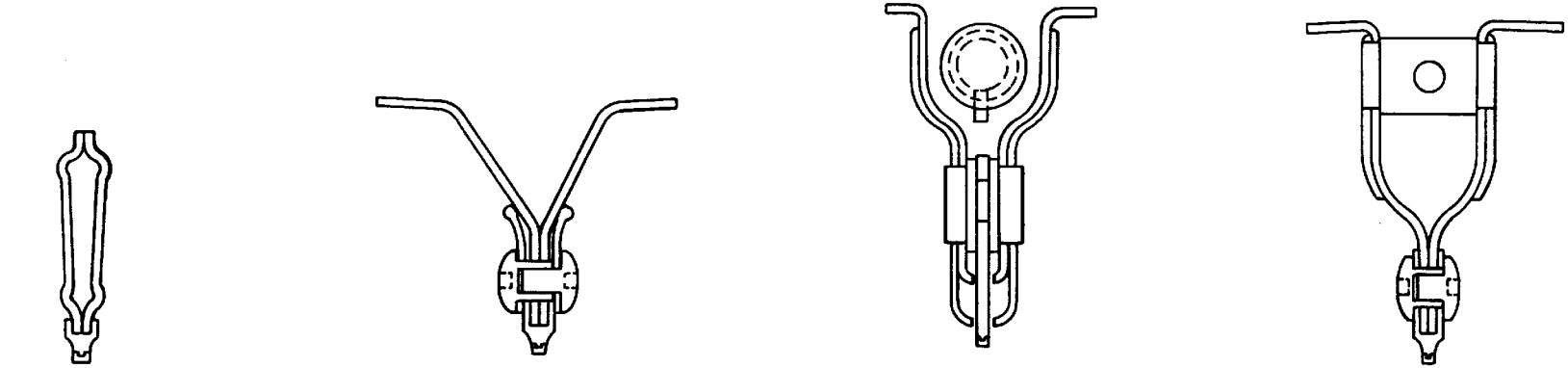

FIG. 5*a* and 5*b* illustrate further cross-sectional views through the skate.

Figure 6:
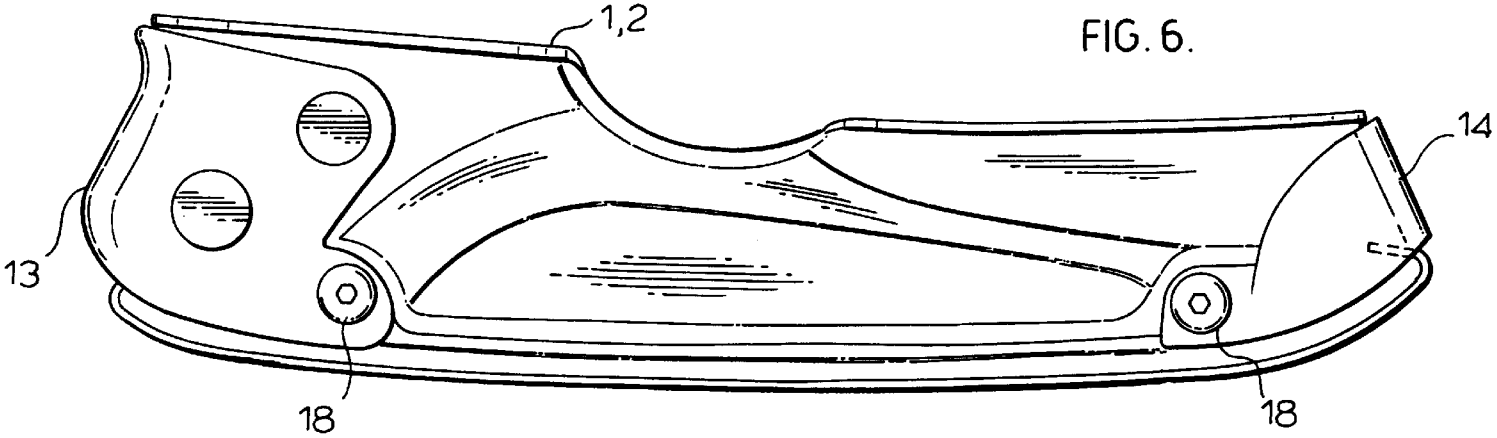
Figure 7:
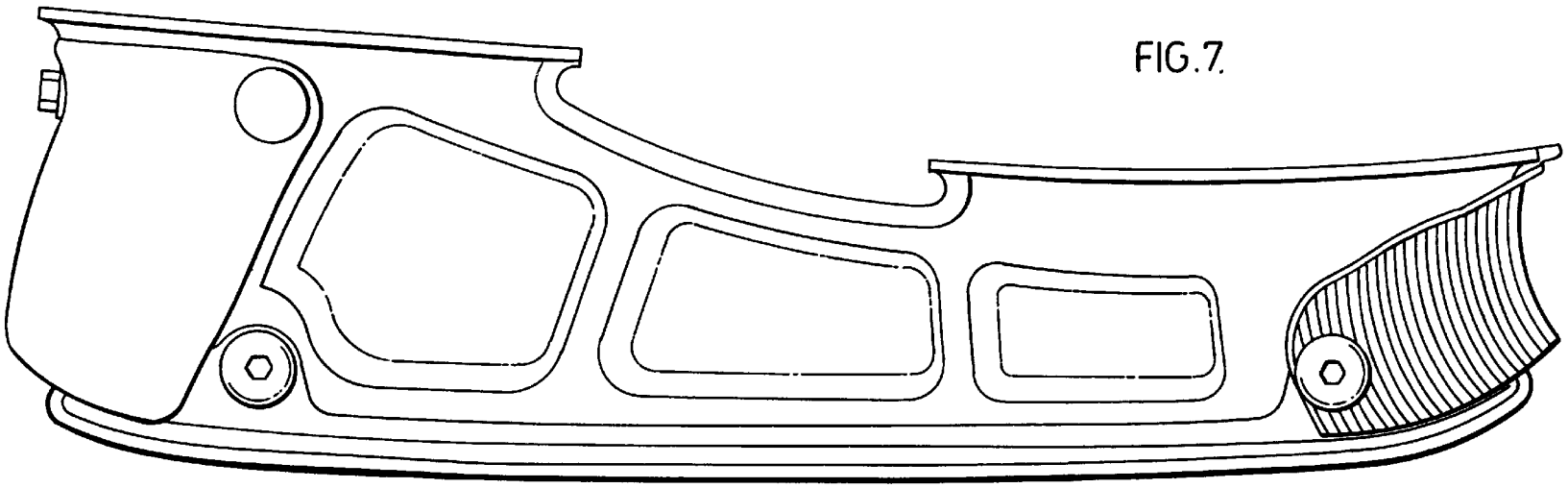
Figure 8:
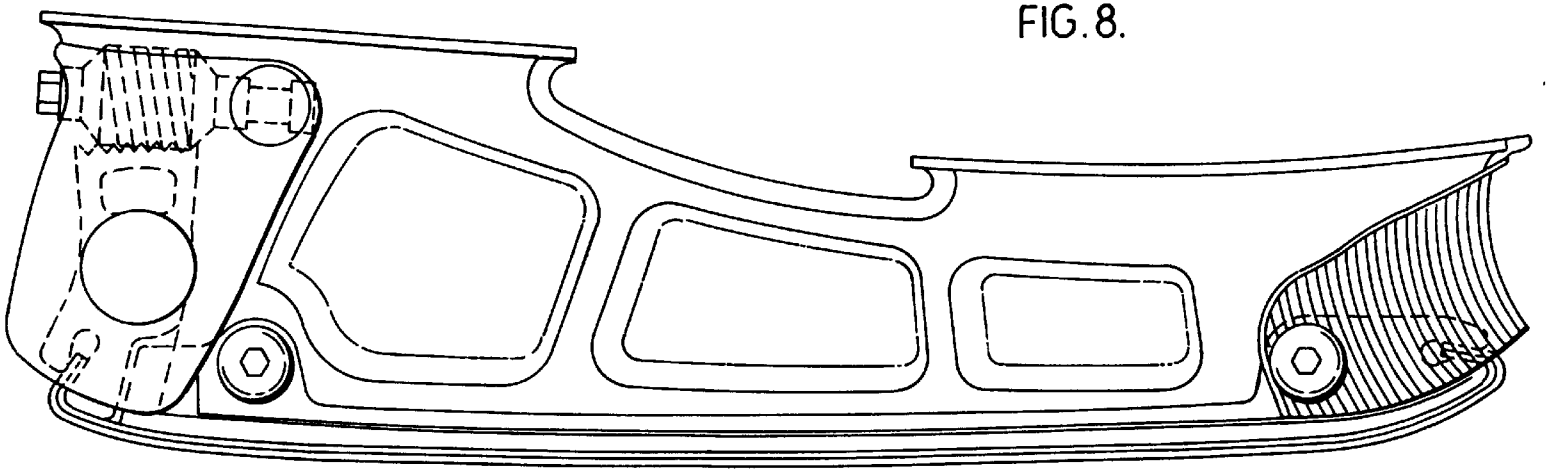

FIG. 6, 7, and 8 are side views of the lower portion of the skate.

Figure 9:
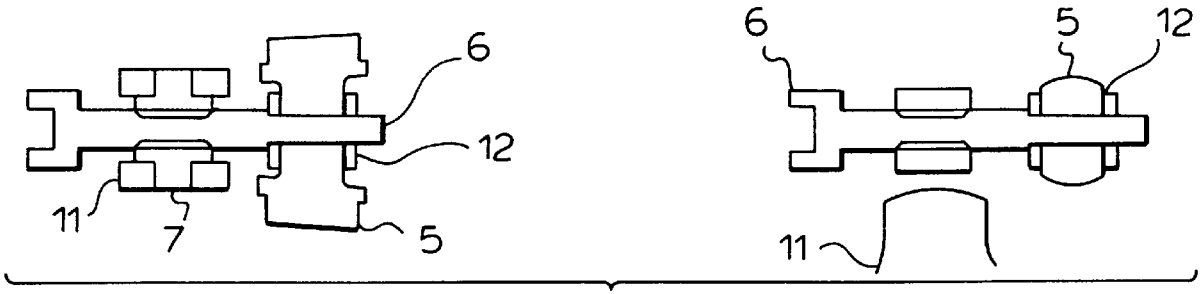

FIG. 9 illustrates two sections through connecting elements of the lower portion of the skate.

Figure 10:
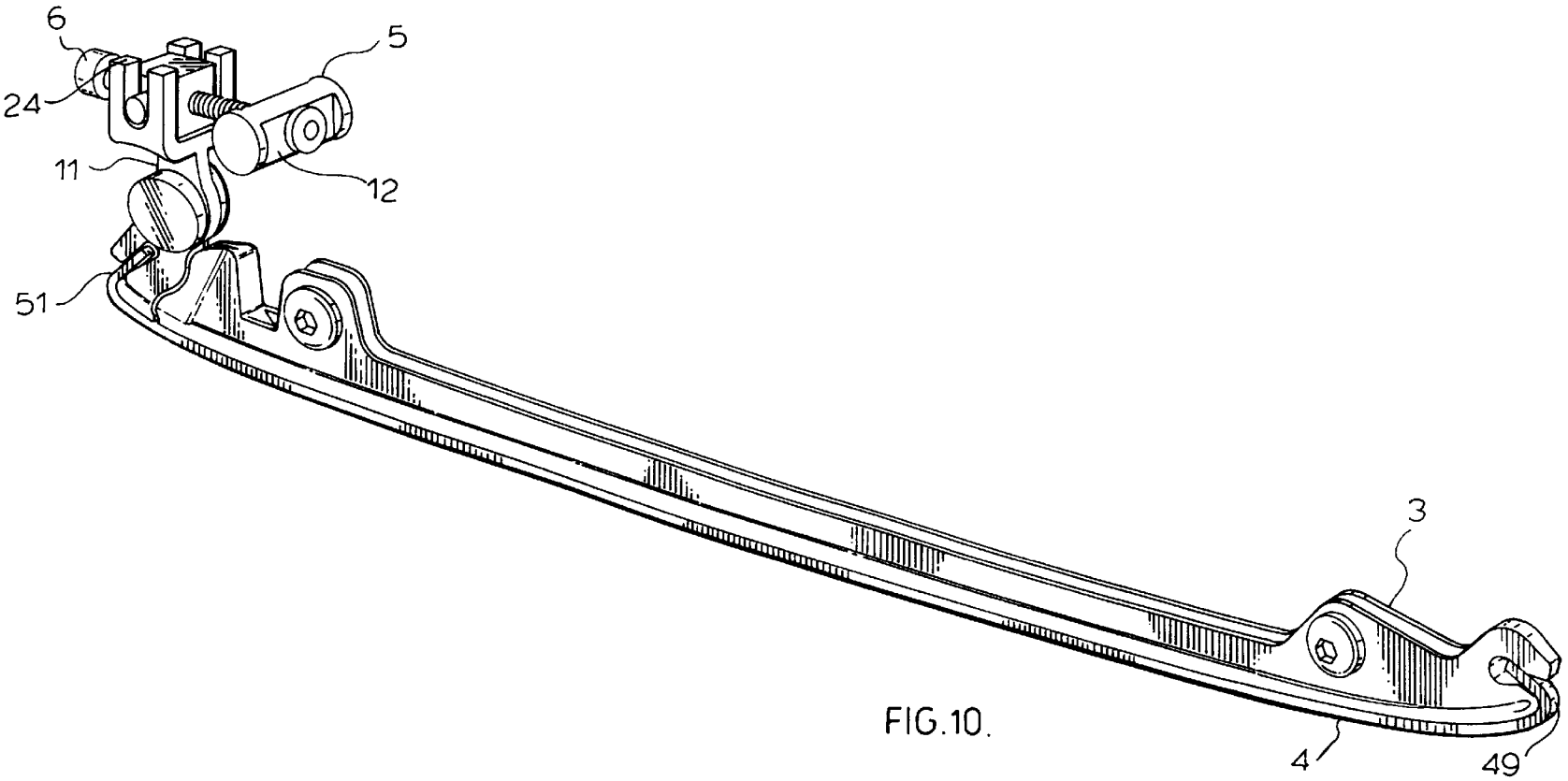

FIG. 10 is a perspective view of the rocker, blade and attachment means.

Figure 11A:
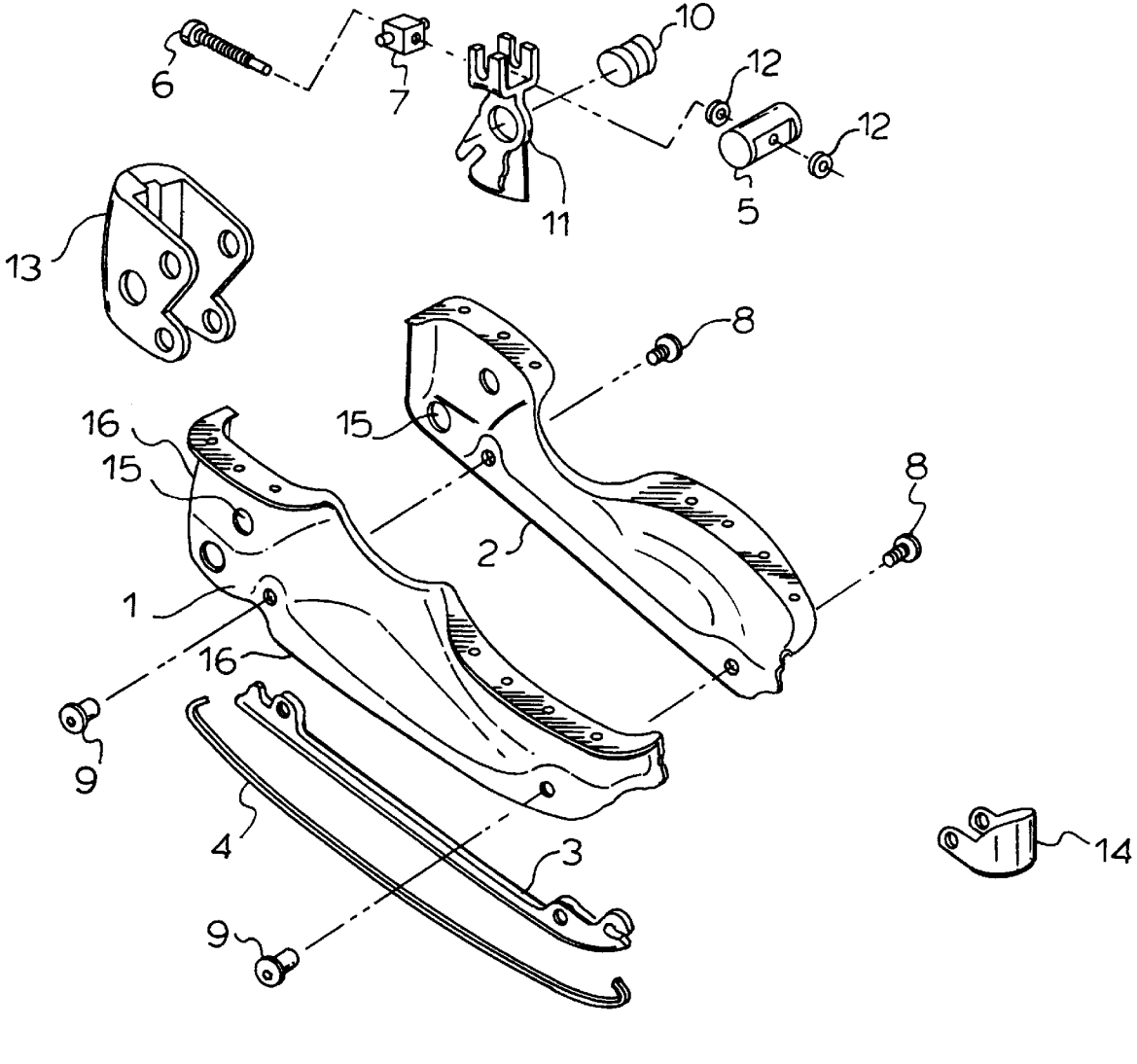
Figure 11B:
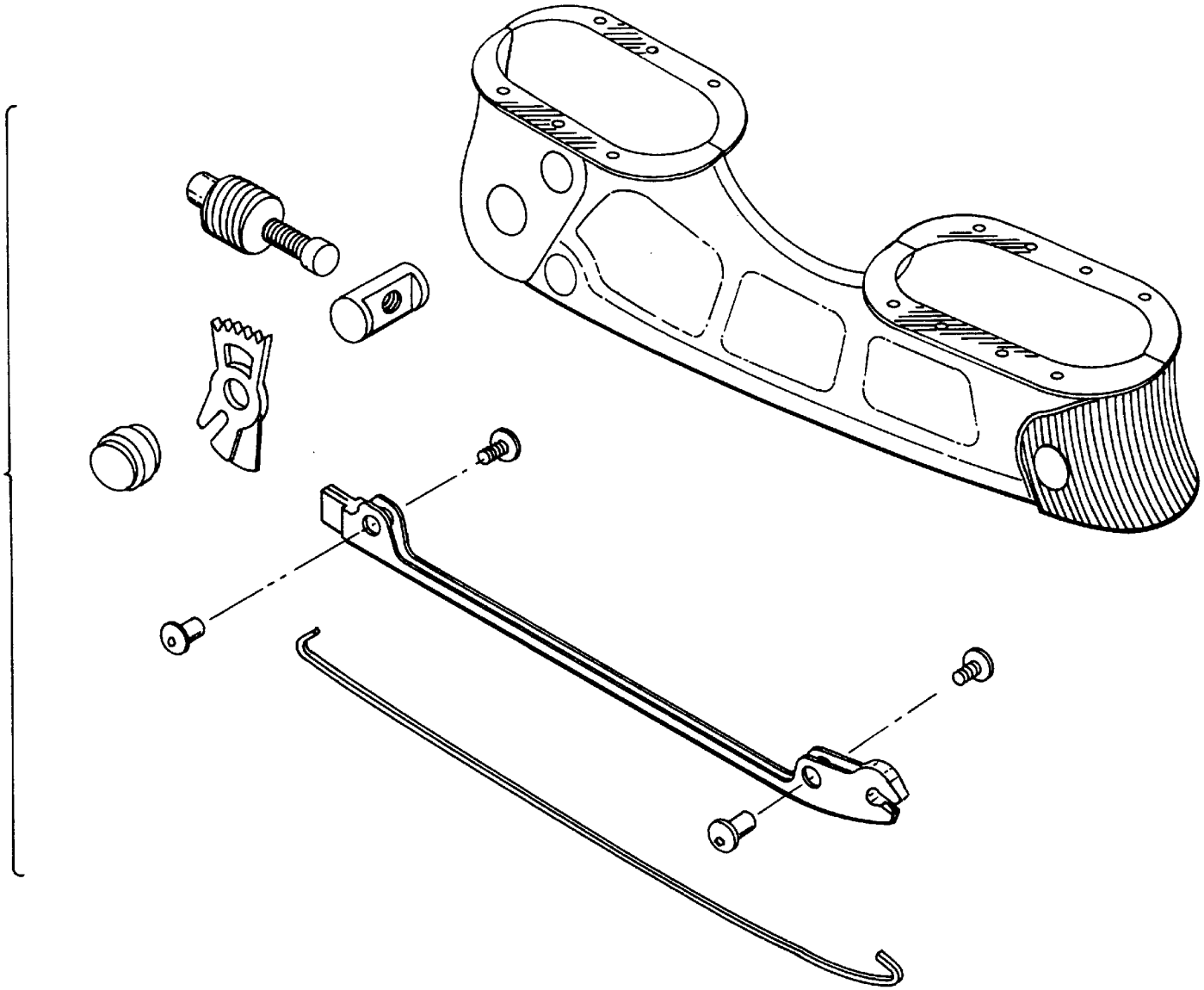

FIG. 11*a* and 11*b* are exploded views of lower skate components.

Figure 12:
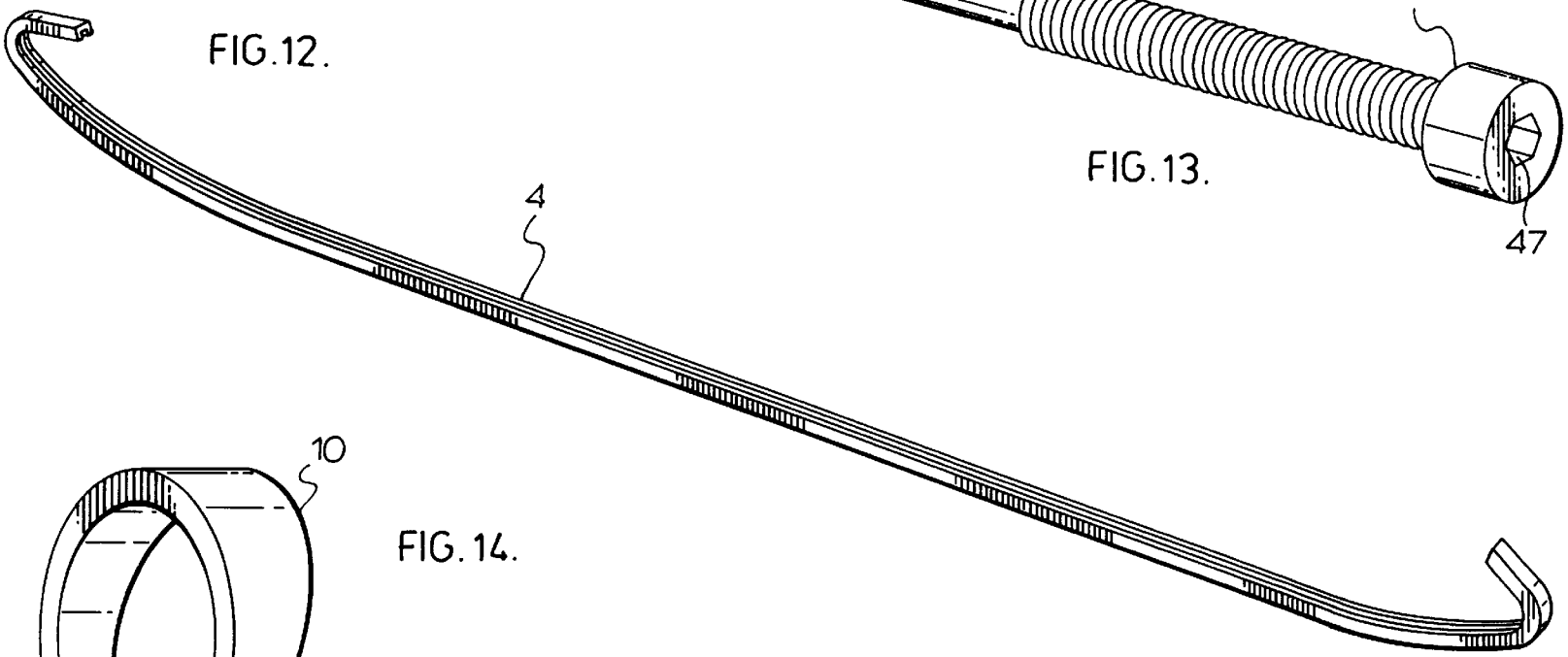

FIG. 12 is a perspective view of the blade.

Figure 13:
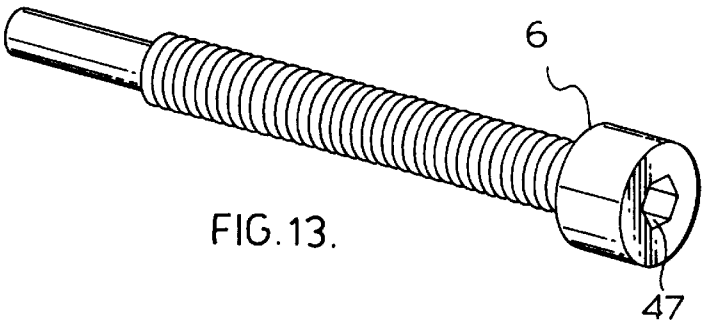

FIG. 13 is a perspective view of the tensioning bolt.

Figure 14:
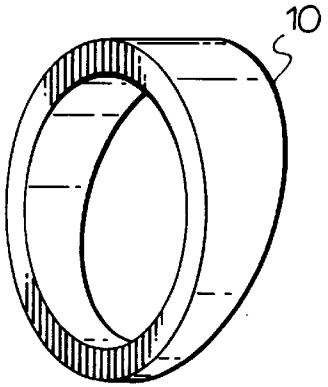

FIG. 14 is a perspective view of the tension plate spacer.

Figure 15:
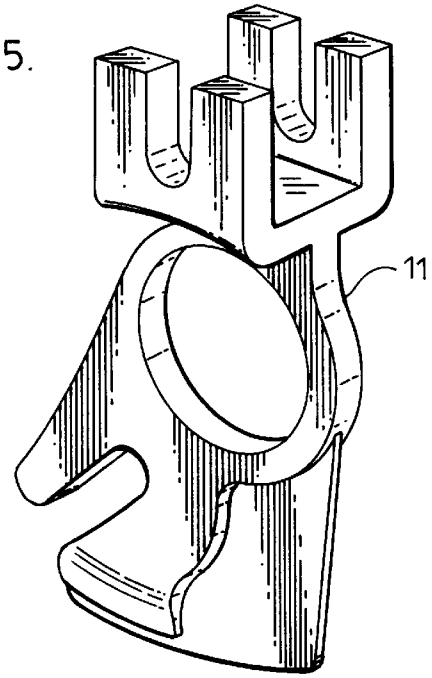

FIG. 15 is a perspective view of the tension plate.

Figure 16:
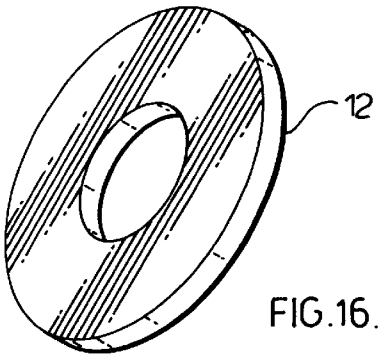

FIG. 16 is a perspective view of the washers.

Figure 17:
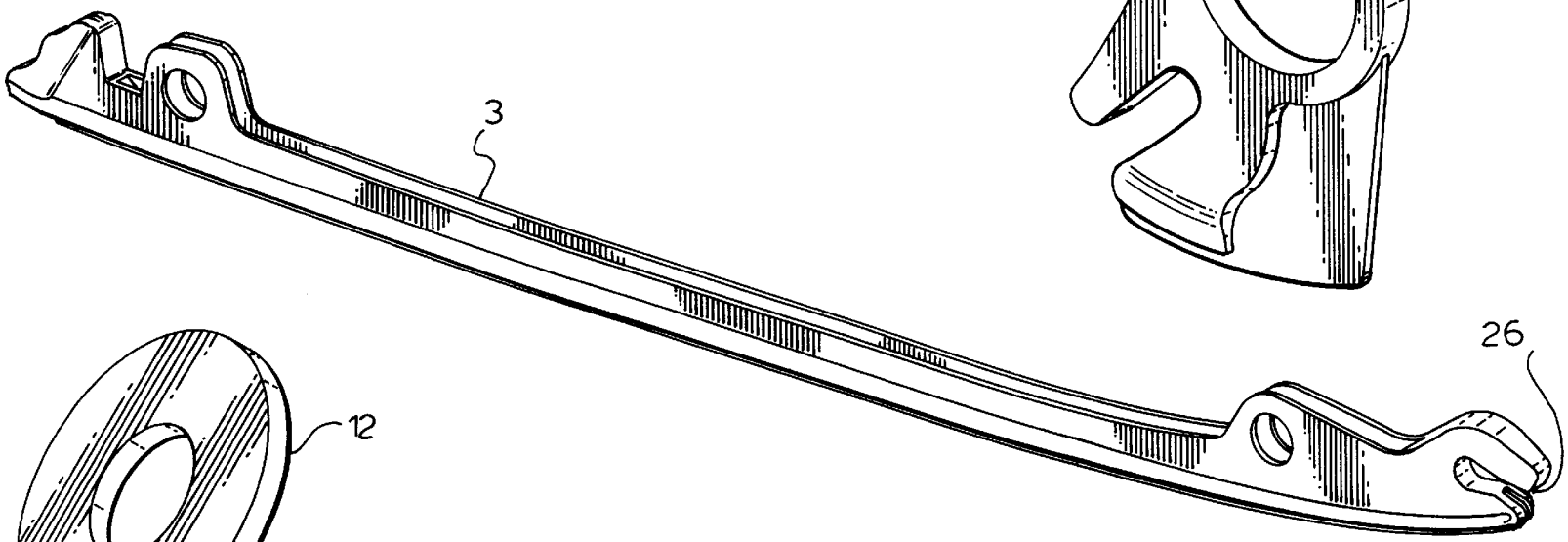

FIG. 17 is a perspective view of the rocker illustrating the toe receiving area.

Figure 18:
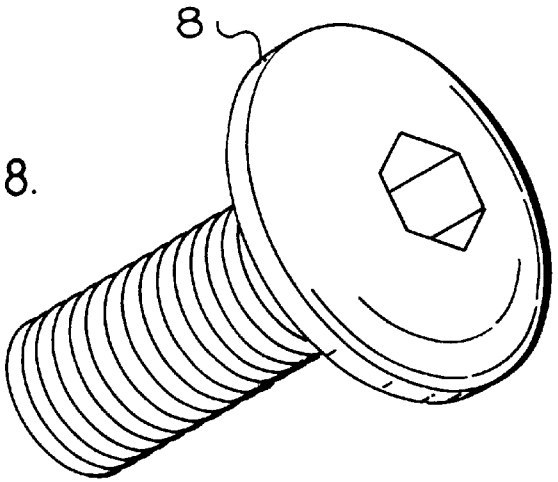

FIG. 18 is a perspective view of the stud.

Figure 19:
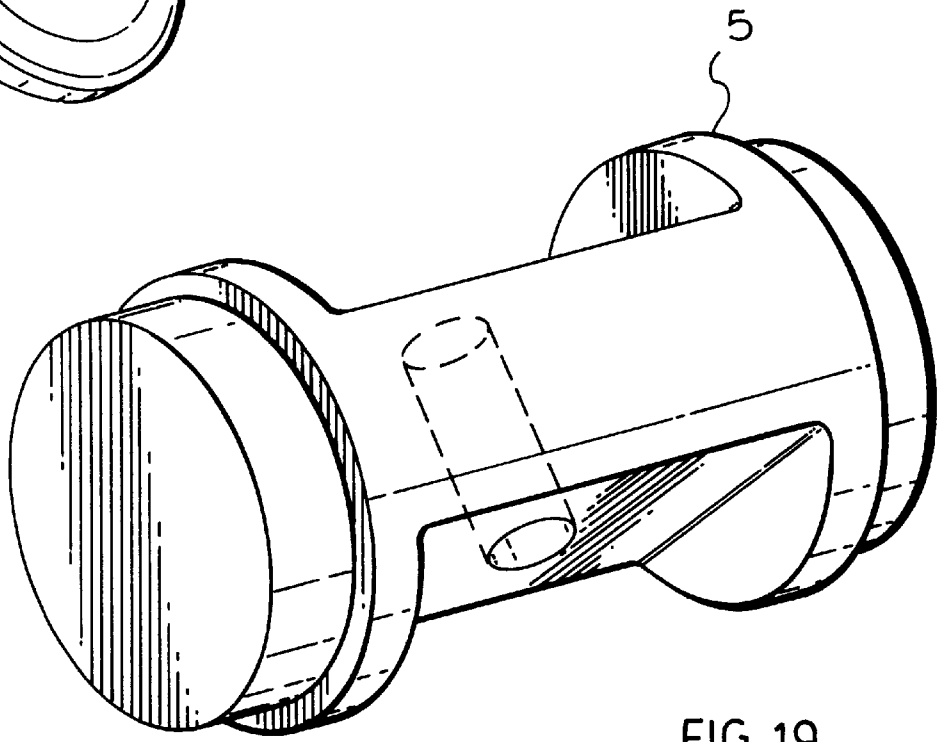

FIG. 19 is a perspective view of the bolt brace.

Figure 20:
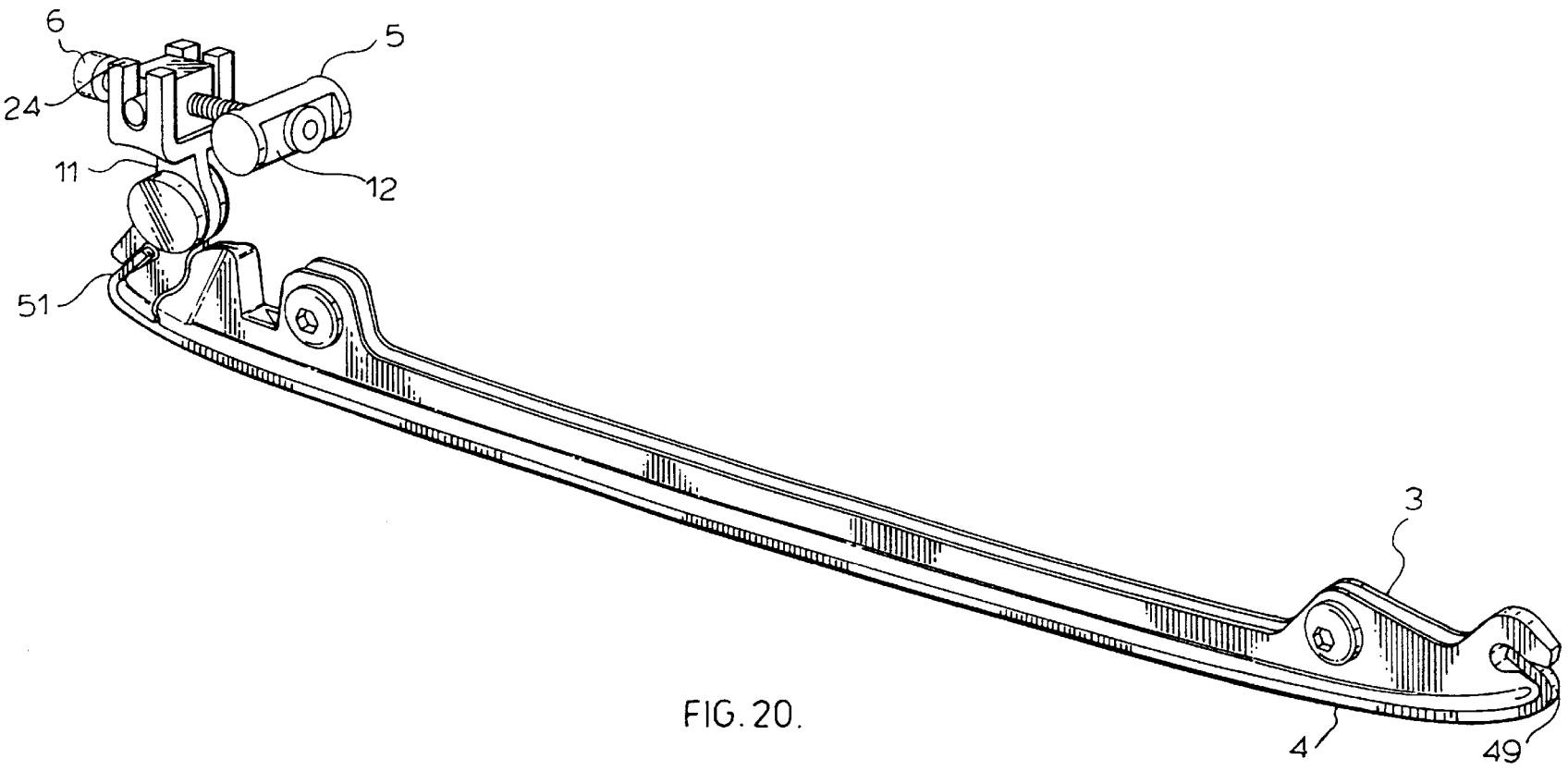

FIG. 20 is a perspective view of the rocker, blade and attachment means.

Figure 21:
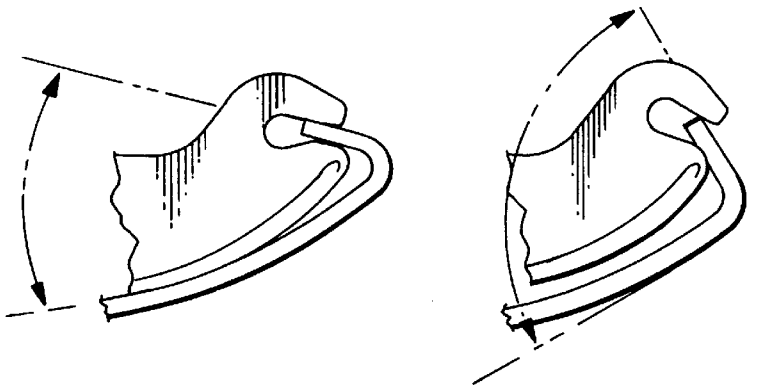
Figure 23:
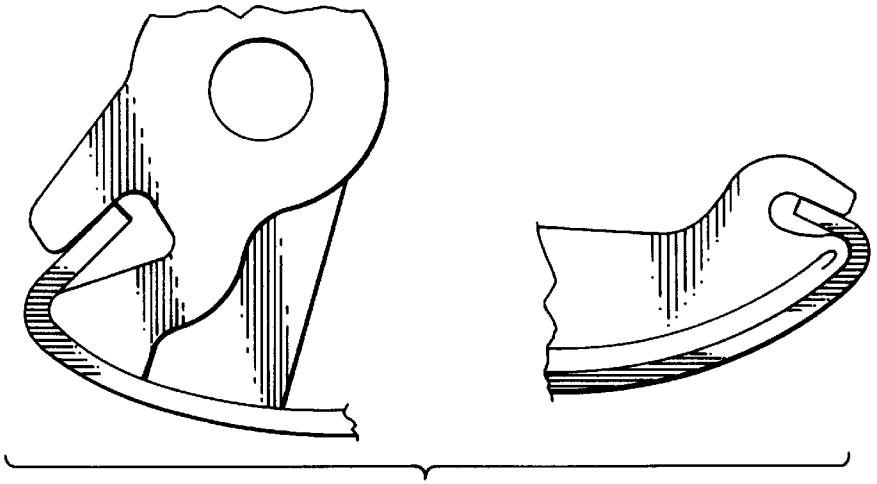

FIG. 21 and 23 illustrate placement of the blade in the toe and heel receiving area.

Figure 22:
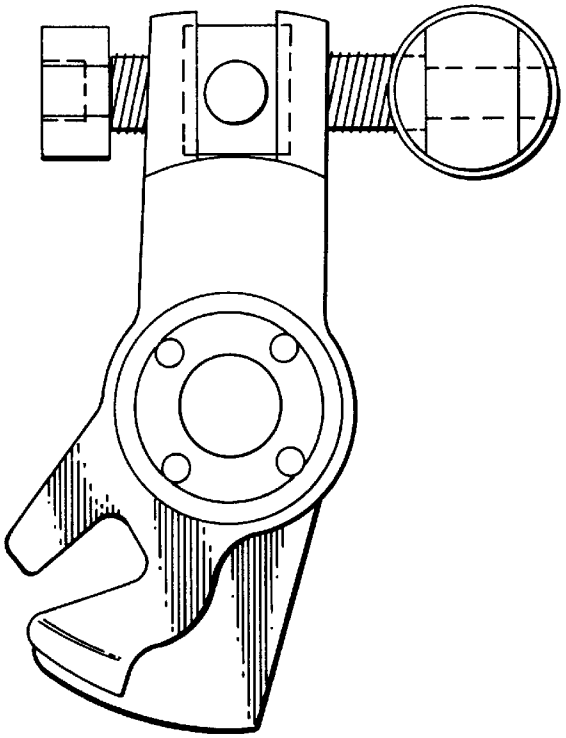

FIG. 22 is a side view of the rear attachment means.

Figure 24:
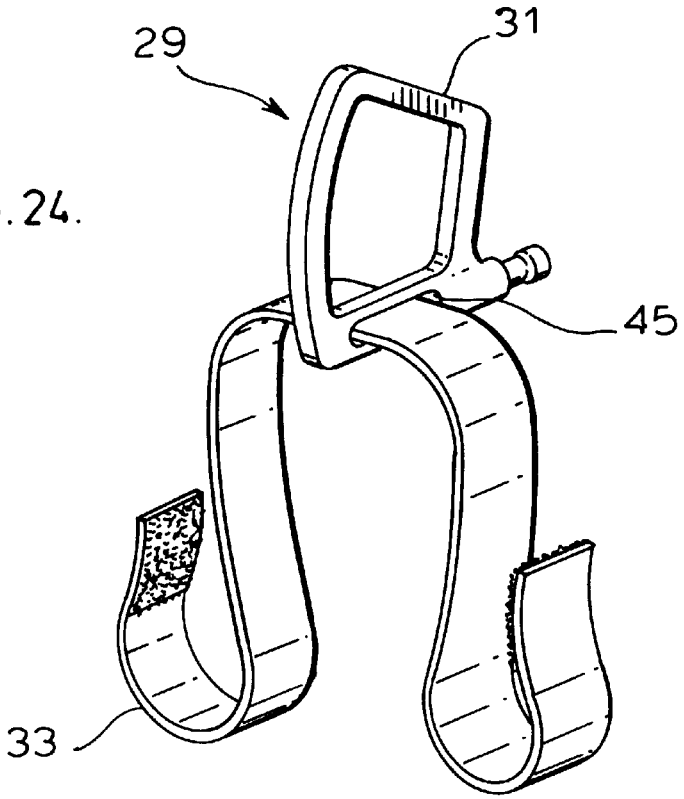

FIG. 24 illustrates the torque limiting wrench and strap.

Figure 24A:
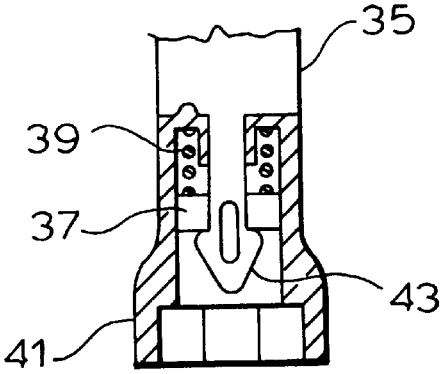

FIG. 24*a* is a cross section of the socket portion of the torque limiting mechanism.

Figure 24B:
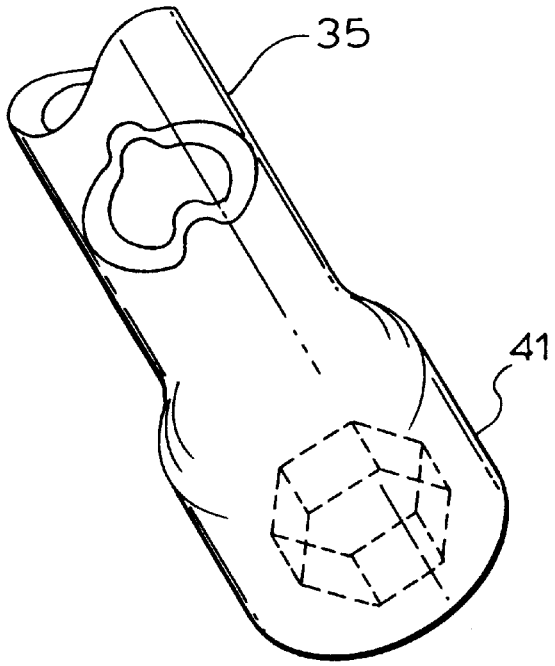

FIG. 24*b* is a plan view of the socket portion of the torque limiting mechanism.

Figure 25:
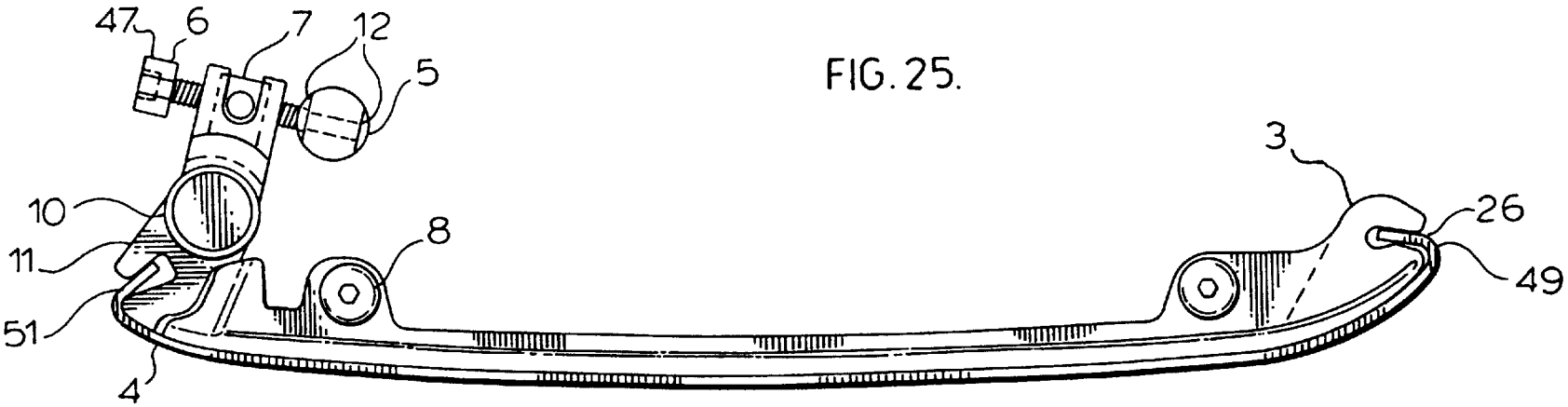

FIG. 25 is a side view of the rocker, blade and attachment means.

Figure 26:
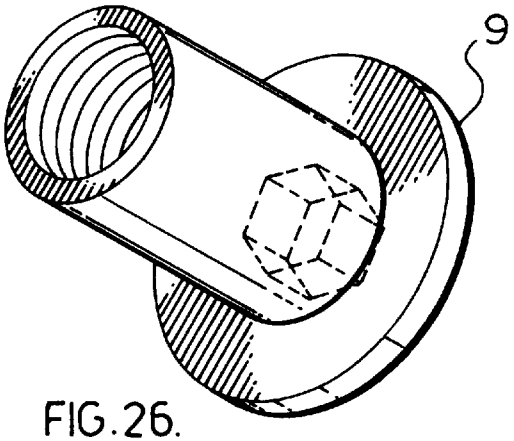

FIG. 26 is a perspective view of the nut.

Figure 27:
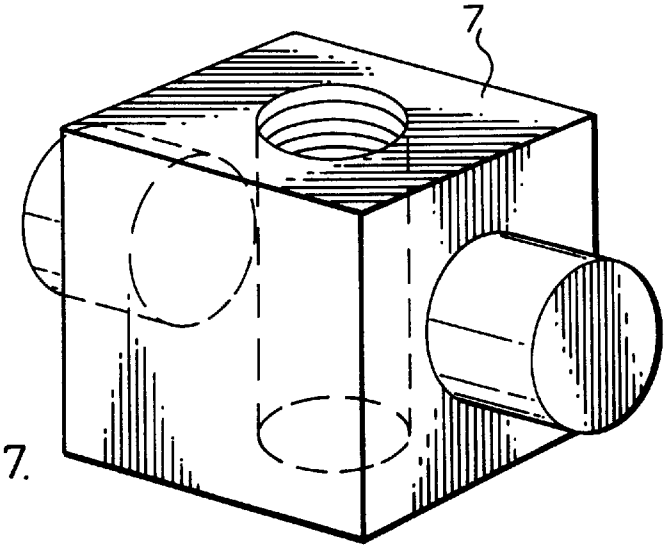

FIG. 27 is a perspective view of the lug nut.

The boot portion of the skate may be formed in any desired shape or colour. The holder to be attached to the boot includes an outside holder 1, an inside holder 2, a rocker 3, a blade 4, a bolt brace 5, a tensioning bolt 6, a lug nut 7, a stud 8, a nut 9, a tension plate spacer 10, a tension plate 11, washers 12, a heel cap 13 and a toe cap 14. The assembly of the skate will now be described with reference to FIGS. 1 through 27.

A first sub-assembly is created by threading the lug nut 7 onto the tensioning bolt 6. A washer 12 is then pushed onto the narrow end of the tensioning bolt 6 until it bottoms on the threaded portion of the tensioning bolt. A bolt brace 5 is then pushed onto the narrow end of the tensioning bolt 6 until it abuts the washer 12. A second washer 12 is pushed onto the narrow end of the tensioning bolt 6 until it abuts the bolt brace 5. The narrow end of the tensioning bolt 6 is then "headed" down, for example by cold forming or riveting, to retain the components which have been placed on it.

Typically, the washers 12 are comprised of steel and serve to prevent the tensioning bolt 6 from breaking the bolt brace 5 which is typically formed of plastic. Use of the washers 12 also allows the tensioning bolt 6 to rotate more readily relative to the bolt brace 5 once the tensioning bolt 6 is headed down.

A second sub-assembly is then prepared. A tension plate spacer 10 is placed on either side of the tension plate 11. The tension plate spacers prevent the tension plate 11 from moving laterally against the outside holder 1 and inside holder 2.

The final assembly is then completed. The outside holder 1 and inside holder 2 are provided with openings 15 to receive the first and second sub-assemblies. The outside and inside holders serve to sandwich the first and second sub-assemblies to create a solid unit. In addition, the rocker 3 sandwiches the outside and inside holder halves 1 and 2 to hold them firmly in place. The inside and outside holders are fastened together, typically with glue, along flanges 16 on the upper, front, lower and rear surfaces thereof.

Next, a plastic heel cap 13 and toe cap 14 are placed over the inside and outside holders 1 and 2. The holders are bolted together with conventional bolts and nuts 18 at the front and rear of the assembly. Each bolt passes through an end cap 13 or 14, a first portion of the rocker 3, the outside holder 1, the inside holder 2, and finally a second portion of the rocker and end cap on the other side.

The rocker 3, which is also replaceable, can be unbolted from the assembly and replaced so that a new rocker with a different curvature can be used.

Finally, the blade 4 is added to the remainder of the assembly. The rocker 3 includes a tongue or ridge 20 running the length of its base. The blade 4 comprises a mating groove 22 adapted to snugly fit over the rocker tongue or ridge.

In order to prepare the holder assembly for the blade, the tensioning bolt 6 is turned in a first direction. This forces the lug nut 7 to move along its axis. The lug nut 7 in turn pushes a yoke 24 at the top of the tension plate 11 until the blade receiving end of the tension plate is moved forward sufficiently to receive the blade 4 in its untensioned state.

The first end 49 of the blade 4 is then hooked into the toe receiving area 26 of the rocker 3. Next, the second end 51 of the blade is hooked into the heel receiving area 28 of the tension plate 11. Finally, the tensioning bolt 6 is rotated in the opposite direction to move the heel receiving area 28 of the tension plate 11 rearward until the blade 4 is tight. The tension plate 11 places the blade 4 under tension in a unique manner and pulls the blade more or less longitudinally, thus reducing bending stresses in the blade.

A torque limiting wrench 29 is adapted to turn the tensioning bolt 6. The use of a torque limiting wrench provides consistent blade tightening and prevents damage to the skate or blade. When the wrench applies force of a preset amount, the tension is released to prevent overtightening. The torque limiting wrench is thus easily used by consumers. Blades may be changed at any time from a supply of spares without the need for special sharpening equipment.

The torque limiting wrench may be provided with a handle 31 and straps 33 for ease in carrying the skates.

The components of an illustrative embodiment of the invention will now be described in more detail.

The blade may be comprised of heat treatable steel which can be through hardened to Rockwell "C" scale 48 or greater. Hardenable varieties of stainless steel may be used to provide corrosion resistance. In the alternative, less expensive non-stainless, hardenable, drawable steel which has moderate to low corrosive resistance, may be employed; minor corrosion will generally not be a significant problem given that the blades are disposable and are not intended for long-term use.

The blades 4 may be made using wire stock. The material for the blades arrives at the drawing/rolling facility in coils of round wire. It is then drawn through wire drawing dies and/or rolled into the desired cross-sectional shape, still in wire form. Following the drawing/rolling process, the material is then sharpened on the lower ice-contacting surface of the blade. Sharpening is typically performed using a grinding operation. The blade is then passed through spring wire bending machines to obtain the proper blade curvature and a defined bend or curvature is imparted to it using computer controlled, or conventional, spring bending machines. As previously stated a blade of a standard curvature may be fitted into rockers of many different curvatures. Such standardized replacement blades are a significant advantage.

The rocker 3 is typically made of conventional die casting aluminum alloy. Liquid aluminum alloy is injected into a die cast cavity in a conventional manner. The tension plate 11 may be made in the same manner as the rocker.

The torque limiting mechanism will now be described in more detail. Referring to FIG. 24, a handle 31 typically made of plastic comprises a torquing bar 35 again typically made of plastic, which is integrated into the handle. A strap 33 passes through the handle 31 and may be used for carrying the skates. The strap 33 is typically comprised of cloth or plastic with a conventional fastener, such as snaps or Velcro™ to allow it to be removably attached through the skates. The mechanism also comprises a retaining ring 37, a spring 39, and a socket portion 41 which is adapted to mate to the head 47 of the tension bolt 6 on the skate.

The torque limiting mechanism may be assembled as follows. The socket portion 41 is pressed over the wedge-shaped flexible snap retainer 43 located on the torquing bar 35. The spring 39 is then placed in position within the socket portion 41 as shown in FIG. 24 (Section A—A). The retaining ring 37 is pressed over the wedge-shaped flexible snap retainer 43 on the torquing bar 35. The retaining ring 37 prevents the spring 39 or socket portion 41 from being removed from the torquing bar 35. Finally, the strap 33 is placed through the slot 45 in the handle 31.

When tightening a blade to the rocker, the socket portion 41 of the torque limiting mechanism is placed over the tensioning bolt head 47 on the skate. A torque is applied to the handle 31. A protrusion in the socket portion 41 is engaged in the mating trough of the torquing bar 35 and is held in place by the force of the spring 39 against the socket portion 41 and the retaining ring 37. The protrusion and trough engagement prevents relative motion between the torquing bar 35 and the socket portion 41 until the torque becomes great enough to drive the protrusion rotationally from the trough. As the protrusion is rotated out of the trough, the spring 39 is forced to compress slightly. Once the protrusion is disengaged from the trough, the rotation of the handle 31 and torquing bar 35 relative to the socket portion 41 can occur with relatively little effort. Thus the socket portion 41 is prevented from applying additional torque to the tensioning bolt on the skate.

The process of attachment of the blade to the rocker will now be described in further detail. The blade 4 is loosely placed into position. The hook at the first or front end of the blade 49 is placed in the gap at the front of the rocker, the toe receiving area 26, and a hook at the second or rear end of the blade 51 is placed into a space adjacent the tension plate, the heel receiving area 28. The upward facing edge of the blade, comprising a groove 22, is engaged into, or fitted over, the tongue or ridge 20 along the lower facing edge of the rocker 3 and the tension plate 11.

The tensioning bolt 6 is turned using the torque limiting wrench 29 as described above. The bolt 6 is engaged with the lug nut 7 by means of threaded portions on both parts. The bolt 6 also passes through the washers 12 and the bolt brace 5 at its non-threaded portion. The end of the bolt 6 is prevented from being removed from the bolt brace 5 by a riveting or staking operation. When the tensioning bolt 6 is rotated, the lug nut 7 is forced toward the forward end of the bolt by the threads. The bolt 6 is held in place by the bolt brace 5. The lugs or posts on the lug nut 7 rest in yokes 24 at the top of the tension plate 11. As the lug nut 7 is forced forward by the bolt 6, it applies pressure to the fingers of the yoke 24 of the tension plate 11. This forces the top of the tension plate 11 to move forward. The tension plate 11 is rotationally pivoted in the skate holders 2 and 3 by posts on the tension plate 11 which fit into corresponding holes in the holders 1 and 2. As the top of the tension plate 11 moves forward, the bottom of the tension plate 11 moves rearward owing to the rotational relationship between the tension plate 11 and the holders 1 and 2. As the bottom of the tension plate 11 moves rearward, it pulls on the rear hook portion of the second end of the blade 51 until the blade 4 becomes tight.

Since the lower portion of the tension plate 11 moves substantially rearward relative to the rocker 3, the blade 4 is tensioned substantially along its natural tangential axis. This helps to prevent the blade from breaking owing to excessive bending stress which can occur if the blade is tensioned around a corner or small radius (as would occur in certain prior devices).

The washers 12 are used primarily to protect the plastic bolt brace 5 from damage owing to the high axial loads on the tensioning bolt 6 which must be restrained by the bolt brace 5.

The foregoing description is intended to be illustrative of an embodiment of the invention. Variations of the construction described will be obvious to those skilled in the art and are intended to be covered by this invention.

What is claimed is:

1. An ice skate comprising:

(a) a boot;

(b) a rigid holder adapted to be mounted to the boot;

(c) the holder having an integral, downward facing rocker with a lower surface of a first defined curvature, a front end and a rear end;

(d) a flexible, replaceable blade having a second curvature when not attached to the skate;

(e) the blade having an upper surface, a lower ice-contacting surface, a front end and a rear end and being adapted to be removably mounted to the rocker;

(f) front attachment means for securing the front end of the blade to the front end of the holder;

(g) rear attachment means for securing the rear end of the blade to the rear end of the holder;

wherein said front and rear attachment means co-operate to create tension along the length of the blade without exerting the major component of tensioning force around a small radius in the region of the front and rear attachment means and wherein the blade conforms to the curvature of the lower surface of the rocker when mounted thereon.

2. An ice skate as defined in claim 1, wherein the blade is provided with a groove along the length of its upper surface, and is adapted to mate with a corresponding ridge along the lower surface of the rocker.

3. An ice skate as defined in claim 1, wherein at least one of the attachment means comprises a torque limiting mechanism.

4. An ice skate as defined in claim 1, wherein the rear attachment means comprises a torque limiting mechanism.

5. An ice skate as defined in claim 1, wherein the blade is capable of being mounted on a rocker having any of a variety of first curvatures.

6. An ice skate as defined in claim 1, wherein the blade is curved more than 90° at both the front end and the rear end thereof for placement and attachment into the front and rear attachment means.

7. An ice skate as defined in claim 1, wherein the blade comprises:

(a) a body formed of heat treatable steel;

(b) first and second ends additionally curved sufficiently to be adapted to be held securely by the front and rear attachment means;

(c) a sharpened, lower ice-contacting surface; and (d) a groove running the length of the upper surface of the blade adapted to mate with a corresponding tongue on the rocker.

8. An ice skate as claimed in claim 1, wherein the rear attachment means is adapted to be engaged by a torque limiting mechanism comprising a torque limiting wrench adapted to impart tension to the blade by removable engagement with the rear attachment means.

9. An ice skate as claimed in claim 1, wherein the front and rear portions of the holder and the blade are covered with tough, impact-resistant end caps.

10. An ice skate as claimed in claim 9, wherein the end caps are coloured.

11. An ice skate as claimed in claim 9, wherein the end caps comprises substantially plastic or artificial rubber material.

12. An ice skate as claimed in claim 1, wherein the holder is mounted to the boot leaving substantially no gap therebetween.

13. An ice skate as defined in claim 8, wherein the torque limiting wrench is mounted on a strap to which the skate may be removably attached.

14. An ice skate as defined in claim 1, wherein the holder is comprised substantially of a composite fibre shell.

15. An ice skate comprising:

(a) a boot;

(b) a rigid holder adapted to be mounted to the boot;

(c) a rigid rocker adapted to be mounted to the holder, the rocker having a front end, a rear end and a lower surface with a defined curvature;

(d) a flexible, replaceable blade having an upper surface, a lower ice-contacting surface, a front end and a rear end, and being adapted to be removably mounted to the rocker;

(e) front attachment means for securing the front end of the blade to the front end of the rocker;

(f) rear attachment means for securing the rear end of the blade to the rear end of the rocker;

wherein said front and rear attachment means co-operate to create tension along the length of the blade when the blade is mounted on the rocker without exerting the major component of tensioning force around a small radius in the region of the front and rear attachment means.

16. An ice skate as defined in claim 15, wherein the blade is provided with a groove along the length of its upper surface, and is adapted to mate with a corresponding ridge along the lower surface of the rocker.

17. An ice skate as defined in claim 15, wherein at least one of the attachment means comprises a torque limiting mechanism.

18. An ice skate as defined in claim 15, wherein the rear attachment means comprises a torque limiting mechanism.

19. An ice skate as defined in claim 15, wherein the blade is capable of being mounted on a rocker having any of a variety of first curvatures.

20. An ice skate as defined in claim 15, wherein the blade is curved more than 90° at both the front end and the rear end thereof for placement and attachment into the front and rear attachment means.

21. An ice skate as defined in claim 15, wherein the blade comprises:

(a) a body formed of heat treatable steel;

(b) first and second ends additionally curved sufficiently to be adapted to be held securely by the front and rear attachment means;

(c) a sharpened, lower ice-contacting surface; and (d) a groove running the length of the upper surface of the blade adapted to mate with a corresponding tongue on the rocker.

22. An ice skate as claimed in claim 15, wherein the rear attachment means is adapted to be engaged by a torque limiting mechanism comprising a torque limiting wrench adapted to impart tension to the blade by removable engagement with the rear attachment means.

23. An ice skate as claimed in claim 15, wherein the front and rear portions of the holder and the blade are covered with tough, impact-resistant end caps.

24. An ice skate as claimed in claim 23, wherein the end caps are coloured.

25. An ice skate as claimed in claim 23, wherein the end caps comprises substantially plastic or artificial rubber material.

26. An ice skate as claimed in claim 15, wherein the holder is mounted to the boot leaving substantially no gap therebetween.

27. An ice skate as defined in claim 22, wherein the torque limiting wrench is mounted on a strap to which the skate may be removably attached.

28. An ice skate as defined in claim 15, wherein the holder is comprised substantially of a composite carbon fibre shell.

* * * * *

UNITED STATES PATENT AND TRADEMARK OFFICE

CERTIFICATE OF CORRECTION

PATENT NO. : 5,988,683

DATED : November 23, 1999

INVENTOR(S) : Fabio Venier and Markus Hetzler

It is certified that error appears in the above-indentified patent and that said Letters Patent is hereby corrected as shown below:

Title page, item [73] Assignee: "Quickblade Inc." should read - - Quikblade Inc. - -

Please insert - -[30] Foreign Application Priority data - - followed by - - Canadian Patent No. 2,169,106 filed February 8, 1996 - -

Signed and Sealed this

Eighteenth Day of July, 2000

*Attest:*

*Attesting Officer*

Q. TODD DICKINSON

*Director of Patents and Trademarks*